US010600558B2

(12) United States Patent
Matsuura et al.

(10) Patent No.: US 10,600,558 B2
(45) Date of Patent: Mar. 24, 2020

(54) ELECTRONIC COMPONENT

(71) Applicant: Murata Manufacturing Co., Ltd., Kyoto-fu (JP)

(72) Inventors: Kouhei Matsuura, Nagaokakyo (JP); Keiichi Tsuduki, Nagaokakyo (JP); Minoru Matsunaga, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 85 days.

(21) Appl. No.: 15/788,158

(22) Filed: Oct. 19, 2017

(65) Prior Publication Data

US 2018/0122563 A1 May 3, 2018

(30) Foreign Application Priority Data

Oct. 31, 2016 (JP) ..... 2016-213613

(51) Int. Cl.
*H01F 27/29* (2006.01)
*H01F 17/00* (2006.01)
(Continued)

(52) U.S. Cl.
CPC ..... *H01F 27/29* (2013.01); *H01B 1/02* (2013.01); *H01F 17/0013* (2013.01);
(Continued)

(58) Field of Classification Search
CPC ..... H01F 17/0006; H01F 2017/0013; H01F 27/29; H01F 27/2804; H01F 27/24; H01F 27/255; H01F 2027/2809; H01B 1/02
(Continued)

(56) References Cited

U.S. PATENT DOCUMENTS 5,250,923 A * 10/1993 Ushiro ..... H01F 17/0013 333/184
5,392,019 A * 2/1995 Ohkubo ..... H01F 17/0013 333/185
(Continued)

FOREIGN PATENT DOCUMENTS

| | | | |
|---|---|---|---|
| CN | 105913997 | A | 8/2016 |
| JP | 2006-66848 | A | 3/2006 |
| JP | 2013-135109 | A | 7/2013 |

OTHER PUBLICATIONS

IAn Office Action mailed by the Chinese Patent Office dated May 23, 2019, which corresponds to Chinese Patent Application No. 201711033242.0 and is related to U.S. Appl. No. 15/788,158 with English language translation.

*Primary Examiner* — Mang Tin Bik Lian
(74) *Attorney, Agent, or Firm* — Studebaker & Brackett PC

(57) ABSTRACT

An electronic component includes a body containing glass, external conductors including a first external electrode and a second external electrode each disposed on an external surface of the body, a spiral conductor within the body, and extended conductors including a first extended conductor and a second extended conductor each disposed within the body. One end portion of the spiral conductor is electrically connected to the first external electrode with the first extended conductor therebetween and another end portion is electrically connected to the second external electrode with the second extended conductor therebetween. The spiral conductor contains Ag and at least one oxide selected from the group consisting of $Al_2O_3$, $SiO_2$, ZnO, $TiO_2$, and $ZrO_2$, and the extended conductor contains Ag, but none of $Al_2O_3$, $SiO_2$, ZnO, $TiO_2$, and $ZrO_2$.

16 Claims, 9 Drawing Sheets

(51) Int. Cl.
*H01B 1/02* (2006.01)
*H01F 27/24* (2006.01)
*H01F 27/28* (2006.01)

(52) U.S. Cl.
CPC ..... *H01F 27/24* (2013.01); *H01F 27/2804* (2013.01); *H01F 27/292* (2013.01); *H01F 2027/2809* (2013.01)

(58) Field of Classification Search
USPC ..... 336/200, 192, 233
See application file for complete search history.

(56) References Cited

U.S. PATENT DOCUMENTS 6,154,114 A * 11/2000 Takahashi ..... H01F 17/0013 336/200
6,504,466 B1 * 1/2003 Katsurada ..... H01F 17/0013 29/602.1
2009/0278649 A1 * 11/2009 Tatsukawa ..... H01F 17/0013 336/200
2010/0046130 A1 * 2/2010 Park ..... H01F 17/0033 361/56
2012/0032767 A1 * 2/2012 Iwasaki ..... H01F 17/0013 336/200
2013/0234820 A1 * 9/2013 Yoo ..... H01F 17/0013 336/200
2013/0257576 A1 * 10/2013 Arata ..... H01F 27/2804 336/200
2014/0078643 A1 * 3/2014 Odahara ..... H01F 17/0013 361/306.3
2014/0097927 A1 * 4/2014 Yamamoto ..... H01F 1/344 336/200
2014/0232504 A1 * 8/2014 Tachibana ..... H01F 17/0013 336/200
2014/0333405 A1 * 11/2014 Choto ..... H01F 1/401 336/200
2016/0314891 A1 10/2016 Onozaki et al.
2018/0096789 A1 * 4/2018 Oshima ..... H01F 17/0013

* cited by examiner

ELECTRONIC COMPONENT

CROSS REFERENCE TO RELATED APPLICATIONS

This application claims benefit of priority to Japanese Patent Application 2016-213613 filed Oct. 31, 2016, the entire content of which is incorporated herein by reference.

TECHNICAL FIELD

The present disclosure relates to an electronic component.

BACKGROUND

Electronic components each including a spiral-shaped conductor (spiral conductor) and an extended conductor that contain Ag and are disposed within a body containing glass have been proposed. Among those electronic components, a number of components that may increase reliability of connection with external electrodes without compromising reliability in insulation have been proposed (for example, Japanese Unexamined Patent Application Publication No. 2013-135109).

Japanese Unexamined Patent Application Publication No. 2013-135109, for example, discloses a common mode noise filter including a multilayer body having a plurality of insulating layers stacked, an external conductor on the external surface of the multilayer body, and a first coil and a second coil within the multilayer body. In this common mode noise filter, the first and second coils each include a spiral-shaped conductor and an extended conductor connecting the spiral-shaped conductor with the external conductor. According to Japanese Unexamined Patent Application Publication No. 2013-135109, the reliability of connection between the spiral-shaped conductor and the external electrode in the common mode noise filter (or common mode choke coil) can be increased by forming the extended conductor to have a thickness larger than the thickness of the spiral-shaped conductor. The insulating layers of the multilayer body are made of an insulating material containing glass.

In electronic components such as common mode choke coils including an Ag-containing spiral-shaped or extended conductor on a glass-containing insulating layer, the Ag in the conductors is likely to diffuse into the glass by firing in the manufacturing process of the electronic component. This is a cause of initial problems with insulation reliability, such as a decrease in insulation resistance (IR). On the other hand, if Ag diffusion is prevented, connection reliability between the extended conductor and the external conductor is decreased.

SUMMARY

Accordingly, the present disclosure provides an electronic component having high connection reliability, in which Ag diffusion into glass caused by firing is reduced in the manufacturing process even though the spiral-shaped conductor and the extended conductor disposed on the glass-containing insulating layer contain Ag.

According to preferred embodiments of the present invention, there is provided an electronic component including a body containing glass, external conductors including a first external electrode and a second external electrode each disposed on an external surface of the body, a spiral conductor disposed within the body, and extended conductors including a first extended conductor and a second extended conductor each disposed within the body. One end portion of the spiral conductor is electrically connected to the first external electrode with the first extended conductor therebetween and another end portion of the spiral conductor is electrically connected to the second external electrode with the second extended conductor therebetween. The spiral conductor contains Ag and at least one oxide selected from the group consisting of $Al_2O_3$, $SiO_2$, ZnO, $TiO_2$, and $ZrO_2$, and the extended conductors contain Ag, but none of $Al_2O_3$, $SiO_2$, ZnO, $TiO_2$, and $ZrO_2$.

Further, the electronic component may be as follows:

(1) The body may include a plurality of insulating layers stacked.

(2) The spiral conductor may be disposed on an insulating layer different from an insulating layer on which the first extended conductor and the second extended conductor are disposed.

(3) The electronic component may have the structure in which the external conductors include a third external electrode and a fourth external electrode each disposed on an external surface of the body, the spiral conductor includes a first spiral conductor and a second spiral conductor disposed on different insulating layers within the body, and the extended conductors further include a third extended conductor and a fourth extended conductor disposed within the body. One end portion of the first spiral conductor is electrically connected to the first external electrode with the first extended conductor therebetween and another end portion of the first spiral conductor is electrically connected to the second external electrode with the second extended conductor therebetween, and one end portion of the second spiral conductor is electrically connected to the third external electrode with the third extended conductor therebetween and another end portion of the second spiral conductor is electrically connected to the fourth external electrode with the fourth extended conductor therebetween. The second spiral conductor is disposed on an insulating layer different from an insulating layer on which the third extended conductor and the fourth extended conductor are disposed. The first spiral conductor and the second spiral conductor are magnetically coupled to each other.

(4) The first to fourth extended conductors may be disposed on the same insulating layer.

(5) The first to fourth extended conductors may be disposed between the first spiral conductor and the second spiral conductor in a direction in which the insulating layers are stacked.

(6) The first to fourth extended conductors may be disposed outside of the spiral conductors in a direction in which the insulating layers are stacked.

(7) The first and second spiral conductors each may include conductors disposed on two or more insulating layers and electrically connected to each other.

(8) The conductors of the first spiral conductor and the conductors of the second spiral conductor may be alternately arranged.

(9) The electronic component may have the structure in which the external conductors further include a fifth external electrode and a sixth external electrode each disposed on an external surface of the body, the spiral conductor further includes a third spiral conductor, and the extended conductors further include a fifth extended conductor and a sixth extended conductor disposed within the body. One end portion of the third spiral conductor is electrically connected to the fifth external electrode with the fifth extended conductor therebetween and another end portion of the third spiral conductor is electrically connected to the sixth external electrode with the sixth extended conductor therebetween. The third spiral conductor is disposed on an insulating layer different from an insulating layer on which the fifth and sixth extended conductors are disposed, different from the insulating layer on which the first spiral conductor is disposed, and different from the insulating layer on which the second spiral conductor is disposed. The first spiral conductor and the third spiral conductor are magnetically coupled to each other. The second spiral conductor and the third spiral conductor are magnetically coupled to each other.

(10) The first to sixth extended conductors may be disposed on the same insulating layer.

(11) The first to sixth extended conductors may be disposed between the first spiral conductor and the second spiral conductor, and/or between the second spiral conductor and the third spiral conductor, and/or between the third spiral conductor and the first spiral conductor in a direction in which the insulating layers are stacked.

(12) The first to sixth extended conductors may be disposed outside of the spiral conductors in a direction in which the insulating layer are stacked.

(13) The first to third spiral conductors each may include conductors disposed on two or more insulating layers and electrically connected to each other.

(14) The body may further include a magnetic layer mainly containing ferrite on at least one side in a direction in which the insulating layers are stacked.

(15) The proportion of the at least one oxide selected from the group consisting of $Al_2O_3$, $SiO_2$, ZnO, $TiO_2$, and $ZrO_2$ in the spiral conductor may be in the range of about 0.1% by mass to 5.0% by mass relative to the total mass of the Ag and the at least one oxide.

The electronic component according to the embodiments of the present invention, which includes a spiral conductor and an extended conductor within a body containing glass, has both reliability in insulation and reliability in connection with external electrodes because the spiral conductor contains Ag and at least one oxide selected from the group consisting of $Al_2O_3$, $SiO_2$, ZnO, $TiO_2$, and $ZrO_2$, while the extended conductor contains Ag but none of $Al_2O_3$, $SiO_2$, ZnO, $TiO_2$, and $ZrO_2$.

Other features, elements, characteristics and advantages of the present disclosure will become more apparent from the following detailed description of preferred embodiments of the present disclosure with reference to the attached drawings.

DETAILED DESCRIPTION

Figure 8:
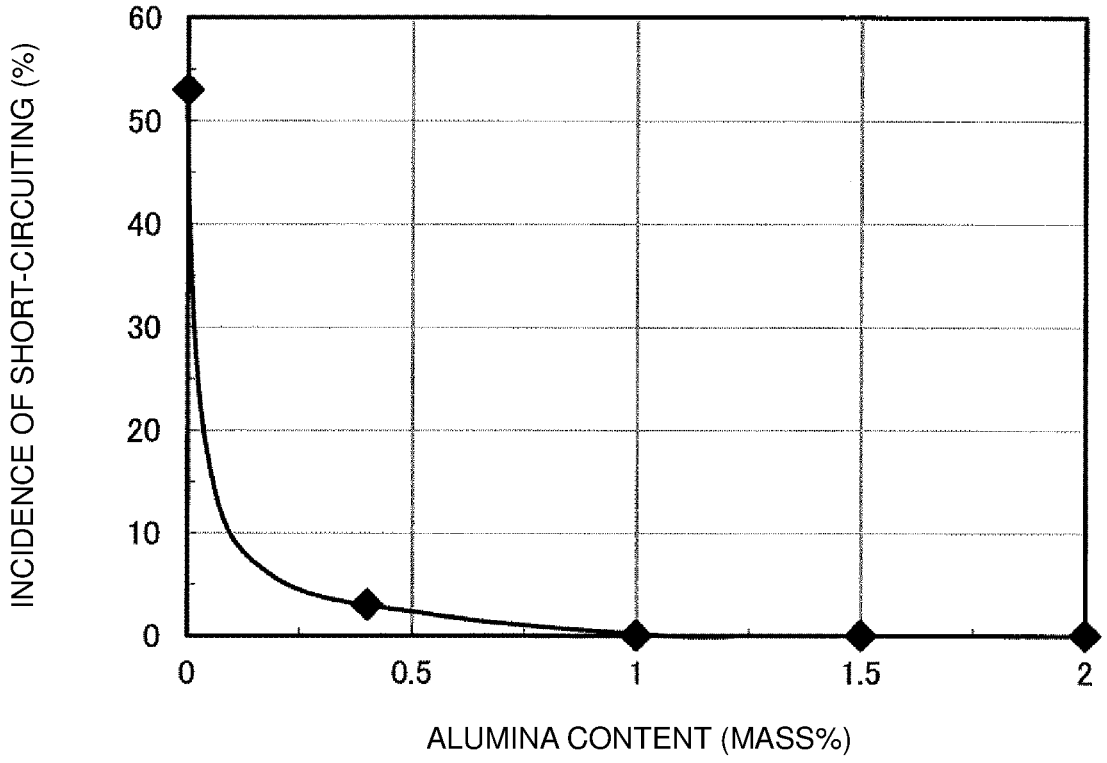
FIG. 8 is a plot of the incidence of short-circuiting between the primary coil and the secondary coil of a common mode choke coil with the $Al_2O_3$ content in the conductor material.

In an attempt to reduce diffusion of Ag into glass in common mode choke coils including a spiral conductor (spiral-shaped conductor) and an extended conductor, each containing Ag and disposed on a glass-containing insulating layer, the present inventors added an oxide selected from the group consisting of $Al_2O_3$, $SiO_2$, ZnO, $TiO_2$, and $ZrO_2$ (hereinafter referred to as oxides, such as $Al_2O_3$, in some cases), in addition to Ag, into the spiral conductor and the extended conductor. As a result, it was confirmed that the addition of the oxide into the Ag-containing conductors reduces diffusion of Ag. For chip inductors including a single coil, suppression of Ag diffusion minimizes the decrease in insulation resistance between adjacent conductors of the spiral conductor and, accordingly, to an improved insulation reliability. For common mode choke coils, suppression of Ag diffusion minimizes not only the decrease in insulation resistance between adjacent conductors of the spiral conductor, but also the incidence of short-circuiting and the decrease in insulation resistance between the primary coil and the secondary coil, thus leading to an improved insulation reliability (see the Table and FIG. 8).

The present inventors, however, found that if an oxide, such as $Al_2O_3$, is added to both the Ag-containing spiral conductor and the Ag-containing extended conductor, the added oxide concentrates at an end portion of the extended conductor (at which a connection to the external conductor will be established) during firing in the manufacturing process of the electronic component. The present inventors also found that if temperature increases, the oxide concentrated at the end portion of the extended conductor draws the constituents of the glass in the insulating layer, such as $SiO_2$, $Al_2O_3$, and $K_2O$, to form a glass coating over the end portion of the extended conductor. The glass coating formed over the end portion of the extended conductor reduces the connection reliability between the extended conductor and the external electrode. These findings suggest that forming both the spiral conductor and the extended conductor of a material containing Ag and an oxide, such as $Al_2O_3$, makes it difficult to ensure a high reliability in connection between the extended conductor and the external electrode.

Accordingly, the present inventors formed a spiral conductor of a material containing Ag and an oxide selected from the group consisting of $Al_2O_3$, $SiO_2$, ZnO, $TiO_2$, and $ZrO_2$ and an extended conductor of a material containing Ag but none of $Al_2O_3$, $SiO_2$, ZnO, $TiO_2$, and $ZrO_2$. Such combination of the spiral conductor and the extended conductor ensured a high reliability in connection between the extended conductor and the external electrode and reduced the diffusion of Ag into the glass.

The present disclosure is based on the above-described findings of the present inventors and provides an electronic component including a body containing glass, a spiral conductor containing Ag and at least one oxide selected from the group consisting of $Al_2O_3$, $SiO_2$, ZnO, $TiO_2$, and $ZrO_2$, and an extended conductor containing Ag but none of $Al_2O_3$, $SiO_2$, ZnO, $TiO_2$, and $ZrO_2$.

The material of the insulating layers of the body may be glass, particularly borosilicate glass (glass containing dominantly silicon dioxide, additionally boron, and optionally one or more other compounds), or a composite material of glass and a Ni—Zn—Cu ferrite mainly containing $Fe_2O_3$, NiO, ZnO, and CuO.

The proportion of the one or more oxides selected from the group consisting of $Al_2O_3$, $SiO_2$, ZnO, $TiO_2$, and $ZrO_2$ in the spiral conductor is in the range of about 0.1% by mass to 5.0% by mass, preferably about 0.5% by mass to 5.0% by mass, and more preferably about 1.0% by mass to 2.0% by mass, relative to the total mass of Ag and the one or more oxides. When the proportion of the one or more oxides is about 0.1% by mass or more, the diffusion of Ag into glass can be suppressed; when it exceeds about 5.0% by mass, the viscosity of the paste for forming electrodes increases. Such paste is not easily formed into the spiral conductor, and reduces the conductivity of the resulting spiral conductor because of the increased proportion of the oxide, which is electrically insulative.

The phrase "containing none of $Al_2O_3$, $SiO_2$, ZnO, $TiO_2$, and $ZrO_2$" or similar expression used herein implies that the content thereof is less than 0.1% by mass being the detection limit of the analysis when quantitatively analyzed by wavelength dispersive X-ray spectroscopy (WDX) under the following conditions:

Analyzer: wavelength dispersive X-ray microanalyzer
Accelerating voltage: 15.0 kV
Field of view: 50 μm×50 μm
(250 points×250 points, each 0.2 μm in size)
Irradiation current: $5\times10^{-8}$ A More specifically, the presence of Ag was observed in the insulating layers around the end portion of the conductor containing Ag but no $Al_2O_3$ by the WDX, compared with the case of the conductor containing $Al_2O_3$ in addition to Ag. This suggests that Ag in the conductor not containing $Al_2O_3$ is diffused into the insulating layer by firing in the manufacturing process of the electronic component. When the conductor contained $Al_2O_3$ in addition to Ag, on the other hand, Ag was not present beyond the detection limit in the insulating layers around the end portion of the conductor; hence, the diffusion of Ag into the insulating layers was suppressed. When $Al_2O_3$ was replaced with $SiO_2$, ZnO, $TiO_2$, or $ZrO_2$, similar results were obtained.

Also, an extended conductor containing $Al_2O_3$ in addition to Ag was observed by the WDX during firing in the manufacturing process of the electronic component. As a result, only Al beyond the detection limit was observed around the end portion of the extended conductor. This suggests that $Al_2O_3$ in the conductor concentrates at the end portion. When the extended conductor was further observed after firing performed at a higher temperature, the presence of Si, Al, and K with high contents was observed around the end portion of the extended conductor. These results suggest that the oxide, such as $Al_2O_3$, that has concentrated at the end portion of the extended conductor draws the constituents of the glass, such as $SiO_2$, $Al_2O_3$, and $K_2O$, in the insulating layers to form a glass coating over the end portion of the extended conductor. The glass coating formed over the end portion of the extended conductor reduces the reliability in connection between the extended conductors and the external electrode. When $Al_2O_3$ was replaced with $SiO_2$, ZnO, $TiO_2$, or $ZrO_2$, similar results were obtained.

Figure 2:
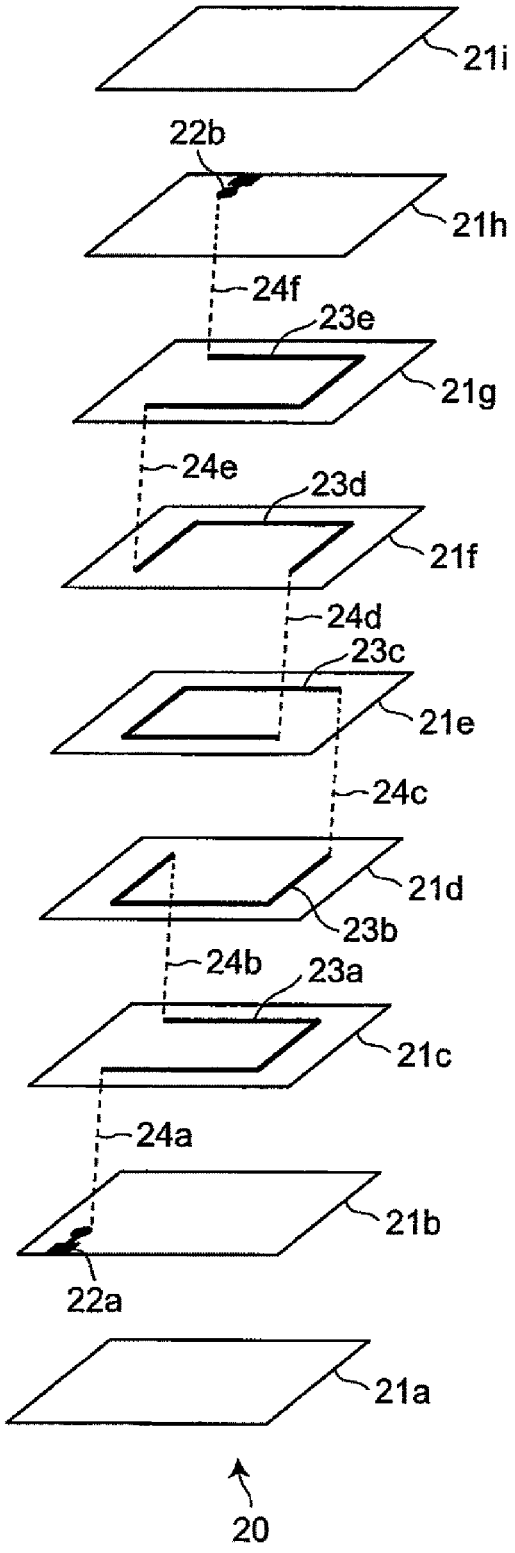
FIG. 2 is a schematic exploded perspective view of an electronic component according to a first embodiment of the present invention.

The "spiral conductor" used herein refers to a conductor in a simple spiral form or a non-rounded spiral form and may be constituted by a plurality of spiral patterns disposed on different insulating layers and electrically connected to each other with VIAs therebetween as shown in FIG. 2, without being limited to the form present on a single insulating layer as shown in FIGS. 3 to 7.

Figure 1:
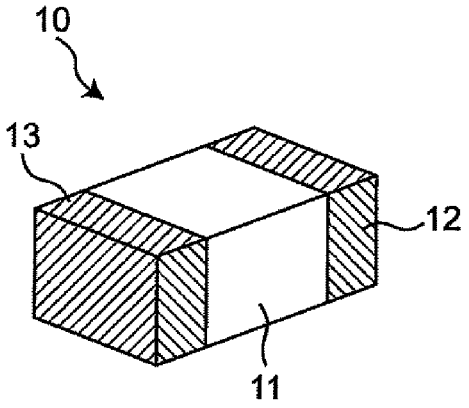
FIG. 1 is an external perspective view of an electronic component according to an embodiment of the present invention.

Electronic components according to some embodiments of the present disclosure will now be described with reference to the drawings. FIG. 1 is an external perspective view of an electronic component of an exemplary embodiment of the present invention. As shown in FIG. 1, the electronic component 10 includes a body 11, a first external electrode 12 disposed on one of opposing end faces of the body 11, and a second external electrode 13 disposed on the other end face. The first external electrode 12 and the second external electrode 13 shown in FIG. 1 are what are called five-face electrodes. The first external electrode 12 covers one of the opposing end faces of the body 11 and portions of the upper and the lower faces and opposing side faces extending from that end face and adjacent to that end face. Similarly, the second external electrode 13 covers the other end face of the body 11 and portions of the upper and the lower faces and opposing side faces extending from the other end face and adjacent to the other end face. In the embodiment shown in FIG. 1, the first external electrode 12 is disposed on one of the opposing end faces perpendicular to the longer axis of the body 11, and the second external electrode 13 is disposed on the other end face. In other embodiments, the external electrodes may be disposed on the side faces parallel to the longer axis of the body 11 or on one of the end faces and the side face adjacent to the end face, without being limited to the foregoing structure.

FIGS. 2 to 7 are schematic exploded perspective views of electronic components according to a first to a sixth embodiment of the present invention. The electronic components 20 to 70 shown in FIGS. 2 to 7 each include a body including a plurality of insulating layers stacked, a plurality of external electrodes (not shown) on the external surface of the body, and a spiral conductor and extended conductors that are disposed within the body. The spiral conductor is connected to the external electrodes with the extended conductors therebetween. The spiral conductor contains Ag and at least one oxide selected from the group consisting of $Al_2O_3$, $SiO_2$, ZnO, $TiO_2$, and $ZrO_2$, and the extended conductors contain Ag but none of $Al_2O_3$, $SiO_2$, ZnO, $TiO_2$, and $ZrO_2$. Desirably, each of the insulating layers has a thickness in the range of about 7 μm to 35 μm, preferably in the range of about 14 μm to 28 μm. Desirably, the spiral conductor has a line width in the range of about 7 μm to 35 μm, preferably in the range of about 10 μm to 24 μm, and a line spacing in the range of about 7 μm to 35 μm, preferably in the range of about 10 μm to 24 μm.

The electronic components of the first to sixth embodiments will now be described in detail with reference to the drawings. In the following description, a plurality of spiral conductors and a plurality of extended conductors each may be designated as a/the n-th spiral conductor or a/the n-th extended conductor (n is an integer of 1 or more). In this instance, the n-th spiral conductor contains Ag and at least one oxide selected from the group consisting of $Al_2O_3$, $SiO_2$, ZnO, $TiO_2$, and $ZrO_2$, and the n-th extended conductor contains Ag but none of $Al_2O_3$, $SiO_2$, ZnO, $TiO_2$, and $ZrO_2$.

First Embodiment

An electronic component 20 according to a first embodiment is embodied as a chip inductor, and includes a 1st to a 9th insulating layer 21*a* to 21*i*, as shown in FIG. 2. A 1st extended conductor 22*a* is disposed on the 2nd insulating layer 21*b*, and a 2nd extended conductor 22*b* is disposed on the 8th insulating layer 21*h*. U-shaped spiral patterns 23*a* to 23*e* are each disposed on one of the 3rd to 7th insulating layers 21*c* to 21*g*. The first extended conductor 22*a* and a spiral pattern 23*a* are electrically connected to each other with a VIA (vertical interconnect access) 24*a* formed in the 3rd insulating layer 21*c*. Similarly, spiral patterns 23*a* and 23*b* are electrically connected to each other with a VIA 24*b* formed in the 4th insulating layer 21*d*; spiral patterns 23*b* and 23*c* are electrically connected to each other with a VIA 24*c* formed in the 5th insulating layer 21*e*; spiral patterns 23*c* and 23*d* are electrically connected to each other with a VIA 24*d* formed in the 6th insulating layer 21*f*; spiral patterns 23*d* and 23*e* are electrically connected to each other with a VIA 24*e* formed in the 7th insulating layer 21*g*; and a spiral pattern 23*e* and the 2nd extended conductor 22*b* are electrically connected to each other with a VIA 24*f* formed in the 8th insulating layer 21*h*. The body (not shown) including the stacked 1st to 9th insulating layers 21*a* to 21*i* is provided with a 1st external electrode on one of the opposing side faces parallel to the longer axis of the body (on the front side in FIG. 2), and with a second external electrode on the other side face. The 1st extended conductor 22*a* is electrically connected to the 1st external electrode, and the 2nd extended conductor 22*b* is electrically connected to the 2nd external electrode.

In the electronic component of the first embodiment, the spiral patterns 23*a* to 23*e* are electrically connected to one another with VIAs 24*b* to 24*e*. Thus, the spiral patterns 23*a* to 23*e* and the VIAs 24*b* to 24*e* constitute a single spiral conductor. One of the end portions of the spiral conductor is electrically connected to the 1st extended conductor 22*a*, and the other is electrically connected to the 2nd extended conductor 22*b*.

The electronic component 20 having such a structure can be manufactured by forming the spiral patterns on the respective insulating layers by, for example, screen printing, stacking the insulating layers, and firing the stack of the insulating layers. In the electronic component of the first embodiment, the reliability in connection between the extended conductors and the external conductors is enhanced without reducing insulation resistance (IR) during firing. More specifically, the presence of Ag and one or more oxides, such as $Al_2O_3$, in the spiral conductor suppresses the diffusion of Ag into glass during firing in the manufacturing process of the electronic component, and the combination of the presence of Ag and the absence of oxides, such as $Al_2O_3$, in the extended conductors prevents the formation of a glass coating over the end portions of the extended conductors during firing. Accordingly, the insulation resistance (IR) between any adjacent spiral patterns of the spiral conductor can be kept high, and the reliability in connection between the extended conductors and the external conductors can be enhanced. The stack of the insulating layers is typically fired at a temperature in the range of about 800° C. to 950° C. for a period in the range of about 30 min to 150 min.

Second Embodiment

Figure 3:
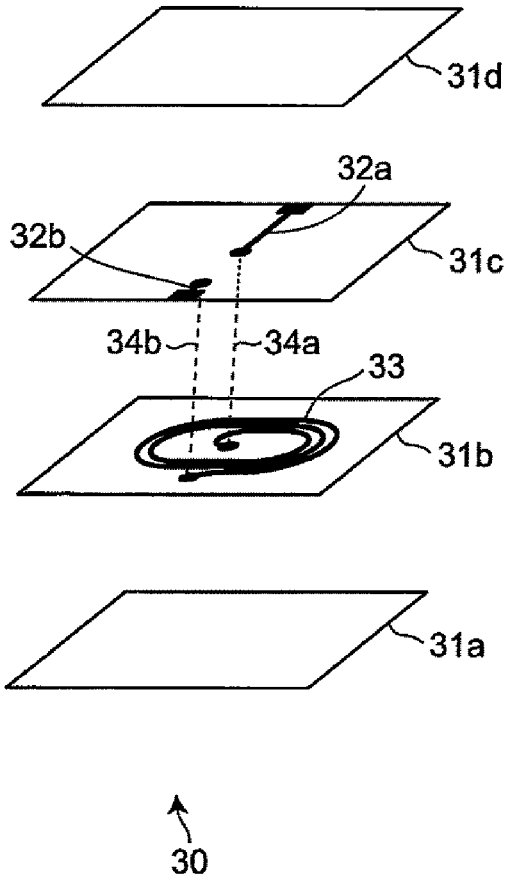
FIG. 3 is a schematic exploded perspective view of an electronic component according to a second embodiment of the present invention.

An electronic component 30 according to a second embodiment is embodied as a chip inductor having a different structure from the chip inductor of the first embodiment, and includes a 1st to a 4th insulating layer 31*a* to 31*d*, as shown in FIG. 3. A 1st extended conductor 32*a* and a 2nd extended conductor 32*b* are disposed on the 3rd insulating layer 31*c*, and a spiral conductor 33 is disposed on the 2nd insulating layer 31*b*. One of the end portions of the spiral conductor 33 is electrically connected to the 1st extended conductor 32*a* with a VIA 34*a* formed in the 3rd insulating layer 31*c*, and the other is electrically connected to the 2nd extended conductor 32*b* with a VIA 34*b* formed in the 3rd insulating layer 31*c*. The body (not shown) including the stacked 1st to 4th insulating layers 31*a* to 31*d* is provided with a 2nd external electrode on one of the opposing side faces parallel to the longer axis of the body (on the front side in FIG. 3), and with a 1st external electrode on the other side face. The 1st extended conductor 32*a* is electrically connected to the first external electrode, and the 2nd extended conductor 32*b* is electrically connected to the 2nd external electrode.

The electronic component 30 having such a structure can be manufactured by forming the 1st extended conductor 32*a* and the 2nd extended conductor 32*b* on the 3rd insulating layer 31*c* by, for example, screen printing, forming the spiral conductor on the 2nd insulating layer 31*b* by, for example, screen printing, and firing a stack of all the insulating layers. In the electronic component 30 of the second embodiment, the reliability in connection between the extended conductors and the external conductors is enhanced without reducing insulation resistance (IR) between two-dimensionally adjacent portions of the spiral conductor 33.

Third Embodiment

Figure 4:
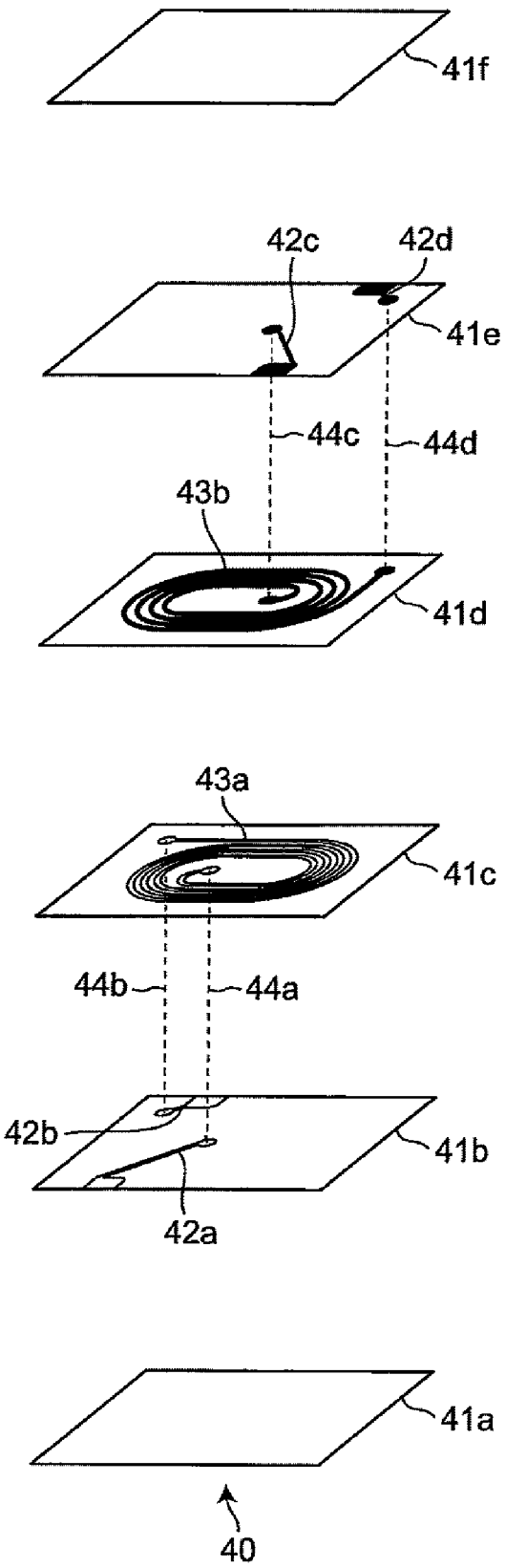
FIG. 4 is a schematic exploded perspective view of an electronic component according to a third embodiment of the present invention.

An electronic component 40 according to a third embodiment is embodied as a common mode choke coil, and includes a 1st to a 6th insulating layer 41*a* to 41*f*, as shown in FIG. 4. A 1st extended conductor 42*a* and a 2nd extended conductor 42*b* are disposed on the 2nd insulating layer 41*b*, and a 3rd extended conductor 42*c* and a 4th extended conductor 42*d* are disposed on the 5th insulating layer 41*e*. A 1st spiral conductor 43*a* (primary coil) is disposed on the 3rd insulating layer 41*c*, and a 2nd spiral conductor 43*b* (secondary coil) is disposed on the 4th insulating layer 41*d*. One of the end portions of the 1st spiral conductor 43*a* is electrically connected to the 1st extended conductor 42*a* with a VIA 44*a* formed in the 3rd insulating layer 41*c*, and the other is electrically connected to the 2nd extended conductor 42*b* with a VIA 44*b* formed in the 3rd insulating layer 41*c*. Similarly, one of the end portions of the 2nd spiral conductor 43*b* is electrically connected to the 3rd extended conductor 42*c* with a VIA 44*c* formed in the 5th insulating layer 41*e*, and the other is electrically connected to the 4th extended conductor 42*d* with a VIA 44*d* formed in the 5th insulating layer 41*e*. The body (not shown) including the stacked 1st to 6th insulating layers 41*a* to 41*f* is provided with a 1st and a 2nd external electrode on one of the opposing side faces parallel to the longer axis of the body (on the front side in FIG. 4), and with a 3rd and a 4th external electrode on the other side face. The 1st extended conductor 42*a* is electrically connected to the 1st external electrode; the 2nd extended conductor 42*b* is electrically connected to the 3rd external connected to the 2nd external electrode; and the 4th extended conductor 42*d* is electrically connected to the 4th external electrode. The 1st spiral conductor 43*a* and the 2nd spiral conductor 43*b* oppose each other with the 4th insulating layer 41*d* therebetween and are magnetically coupled.

The electronic component 40 having such a structure can be manufactured by forming the 1st extended conductor 42*a* and the 2nd extended conductor 42*b* on the 2nd insulating layer 41*b*, the 3rd extended conductor 42*c* and the 4th extended conductor 42*d* on the 5th insulating layer 41*e*, the 1st spiral conductor 43*a* on the 3rd insulating layer 41*c*, and the 2nd spiral conductor 43*b* on the 4th insulating layer 41*d* by, for example, screen printing, and firing a stack of all the insulating layers. In the electronic component 40 of the third embodiment, the 1st and the 2nd spiral conductor 43*a* and 43*b* contain one or more oxides, such as $Al_2O_3$, in addition to Ag. This suppresses the diffusion of Ag into glass during firing in the manufacturing process of the electronic component. Consequently, a decrease in insulation resistance between the 1st spiral conductor 43*a* and the 2nd spiral conductor 43*b* is minimized. In addition, the reliability of connection between the extended conductors and the corresponding external conductors is enhanced without reducing insulation resistance (IR) during firing, as in the first to third embodiments.

Fourth Embodiment

Figure 5:
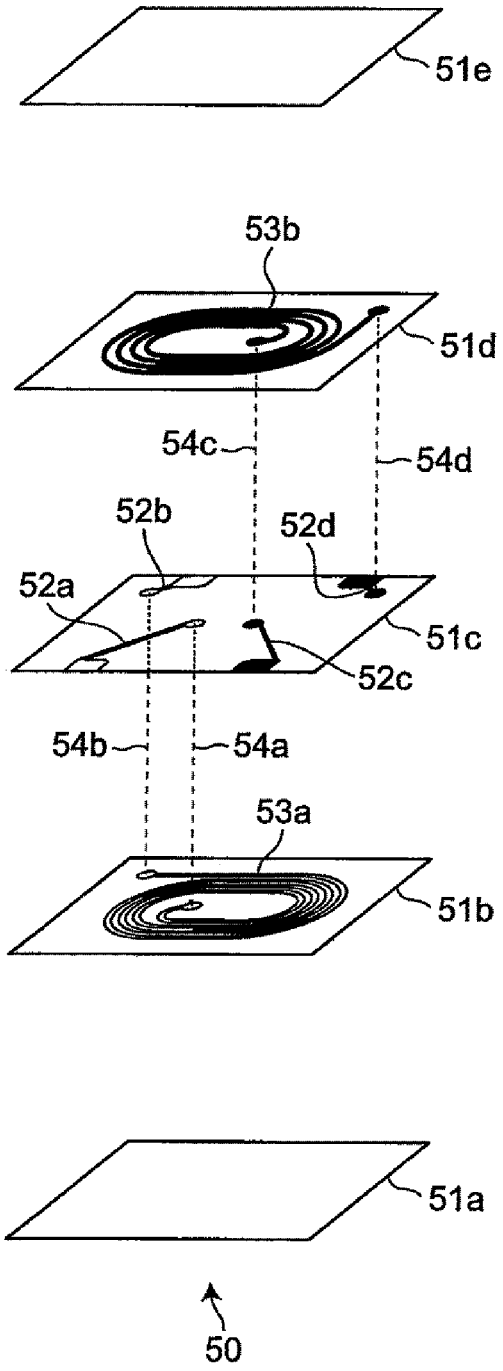
FIG. 5 is a schematic exploded perspective view of an electronic component according to a fourth embodiment of the present invention.

An electronic component 50 according to a fourth embodiment is a common mode choke coil having different extended conductors from the electronic component 40 of the third embodiment in terms of the following two points: (a) all of the four extended conductors, a 1st to a 4th extended conductor 52*a* to 52*d*, are disposed together on a single 3rd insulating layer 51*c*; and (b) the 3rd insulating layer 51*c* having the four 1st to 4th extended conductors 52*a* to 52*d* thereon is disposed between a 2nd insulating layer 51*b* having a 1st spiral conductor 53*a* (primary coil) thereon and a 4th insulating layer 51*d* having a 2nd spiral conductor 53*b* (secondary coil) thereon, as shown in FIG. 5. One of the end portions of the 1st spiral conductor 53*a* is electrically connected to the 1st extended conductor 52*a* with a VIA 54*a* formed in the 3rd insulating layer 51*c*, and the other is electrically connected to the 2nd extended conductor 52*b* with a VIA 54*b* formed in the 3rd insulating layer 51*c*. Similarly, one of the end portions of the 2nd spiral conductor 53*b* is electrically connected to the 3rd extended conductor 52*c* with a VIA 54*c* formed in the 4th insulating layer 51*d*, and the other is electrically connected to the 4th extended conductor 52*d* with a VIA 54*d* formed in the 4th insulating layer 51*d*. The body (not shown) including the stacked 1st to 5th insulating layers 51*a* to 51*e* is provided with a 1st and a 2nd external electrode on one of the opposing side faces parallel to the longer axis of the body (on the front side in FIG. 5), and with a 3rd and a 4th external electrode on the other side face. The 1st extended conductor 52*a* is electrically connected to the 1st external electrode; the 2nd extended conductor 52*b* is electrically connected to the 3rd external electrode; the 3rd extended conductor 52*c* is electrically connected to the 2nd external electrode; and the 4th extended conductor 52*d* is electrically connected to the 4th external electrode. The 1st spiral conductor 53*a* and the 2nd spiral conductor 53*b* oppose each other with the 3rd and 4th insulating layers 51*c* and 51*d* therebetween and are magnetically coupled.

The electronic component 50 of the fourth embodiment having such a structure produces the same effect as in the third embodiment. In addition, the structure of this embodiment allows simultaneous formation of all of the four 1st to 4th extended conductors 52*a* to 52*d* together on the single 3rd insulating layer 51*c* by printing or the like and a reduction of the number of insulating layers, resulting in a reduced manufacturing cost. The arrangement in which the 3rd insulating layer 51*c* having the 1st to 4th extended conductors 52*a* to 52*d* thereon is located between the 1st spiral conductor 53*a* (primary coil) and the 2nd spiral conductor 53*b* (secondary coil) provides a larger distance between the 1st spiral conductor 53*a* (primary coil) and the 2nd spiral conductor 53*b* (secondary coil), and, accordingly, reduces the stray capacitance generated between the spiral conductors, resulting in improved signal transmission.

Modification of Fourth Embodiment

Although, in the fourth embodiment, the insulating layer 51*c* having the 1st to 4th extended conductors 52*a* to 52*d* thereon is located between the 1st spiral conductor 53*a* (primary coil) and the 2nd spiral conductor 53*b* (secondary coil), the insulating layer 51*c* having the 1st to 4th extended conductors 52*a* to 52*d* thereon may be located outside the portion between the spiral conductors and adjacent to the 1st spiral conductor 53*a* (primary coil) or the 2nd spiral conductor 53*b* (secondary coil). In this instance, the distance between the two spiral conductors, that is, the 1st spiral conductor 53*a* (primary coil) and the 2nd spiral conductor 53*b*, can be reduced, and accordingly, the magnetic coupling therebetween can be enhanced. As described above, the common mode choke coil according to the electronic component of the fourth embodiment may be modified in a variety of ways according to the specifications required.

Fifth Embodiment

Figure 6:
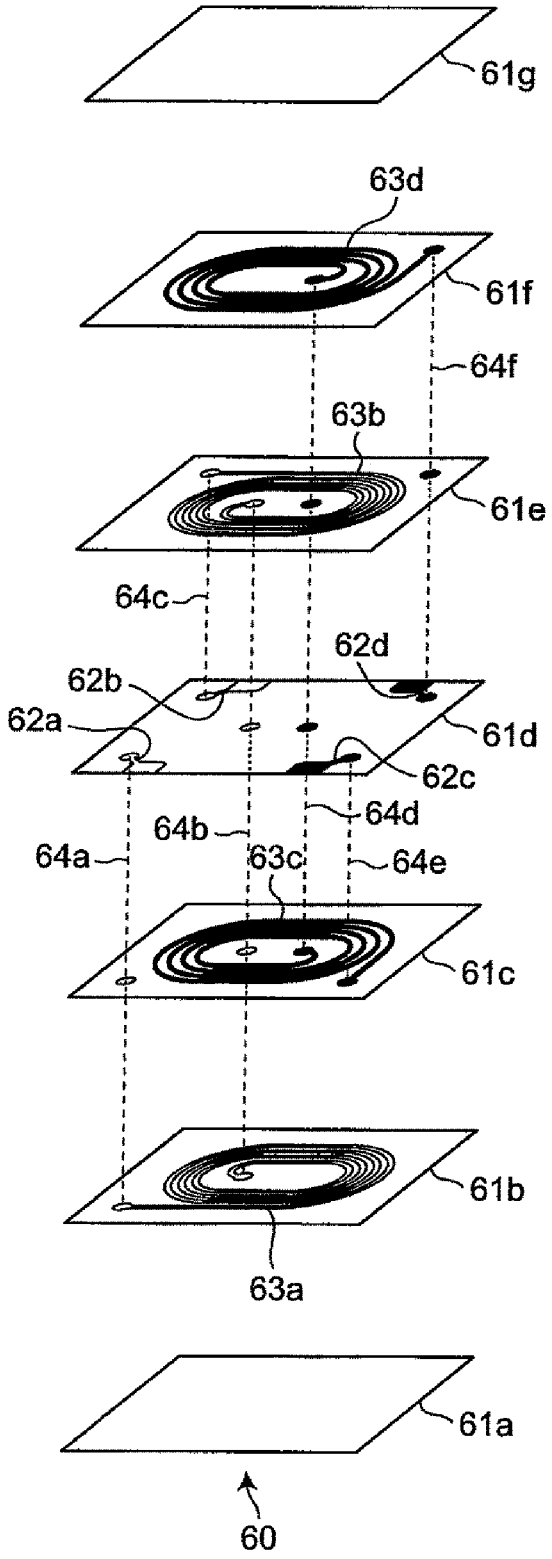
FIG. 6 is a schematic exploded perspective view of an electronic component according to a fifth embodiment of the present invention.

An electronic component according to a fifth embodiment is a common mode choke coil including a first spiral conductor including two spiral conductors that are connected to each other with a VIA formed in one or more insulating layers and a second spiral conductor including two spiral conductors that are connected to each other with a VIA formed in one or more insulating layers, as shown in FIG. 6. More specifically, the electronic component 60 of the fifth embodiment includes a 1st to a 7th insulating layer 61*a* to 61*g*, and in which a 1st extended conductor 62*a*, a 2nd extended conductor 62*b*, a 3rd extended conductor 62*c*, and a 4th extended conductor 62*d* are disposed on the 4th insulating layer 61*d* located at the center of the structure, as shown in FIG. 6. A 1st-A spiral conductor 63*a* is disposed on the 2nd insulating layer 61*b*, and a 1st-B spiral conductor 63*b* is disposed on the 5th insulating layer 61*e*. The 1st-A spiral conductor 63*a* and the 1st-B spiral conductor 63*b* are connected to each other at each one end portion with a VIA 64*b* continuously passing through insulating layers 61*e*, 61*d*, and 61*c*, thus defining the 1st spiral conductor (primary coil). The other end portion of the 1st-A spiral conductor 63*a* is connected to the 1st extended conductor 62*a* with a VIA 64*a* continuously passing through insulating layers 61*c* and 61*d*, and the other end portion of the 1st-B spiral conductor 63*b* is connected to the 2nd extended conductor 62*b* with a VIA 64*c* formed in the insulating layer 61*e*. Thus, the first spiral conductor (primary coil) is connected to the 1st extended conductor 62*a* and the 2nd extended conductor 62*b*.

A 2nd-C spiral conductor 63*c* is disposed on the 3rd insulating layer 61*c*, and a 2nd-D spiral conductor 63*d* is disposed on the 6th insulating layer 61*f*. The 2nd-C spiral conductor 63*c* and the 2nd-D spiral conductor 63*d* are connected to each other at each one end portion with a VIA 64*d* continuously passing through insulating layers 61*d*, 61*e*, and 61*f*, thus defining the 2nd spiral conductor (secondary coil). The other end portion of the 2nd-C spiral conductor 63*c* is connected to the 3rd extended conductor 62*c* with a VIA 64*e* formed in the insulating layer 61*d*, and the other end portion of the 2nd-D spiral conductor 63*d* is connected to the 4th extended conductor 62*d* with a VIA 64*f* continuously passing through insulating layers 61*e* and 61*f*. Thus, the second spiral conductor (secondary coil) is connected to the 3rd extended conductor 62*c* and the 4th extended conductor 62*d*. The body (not shown) including the stacked 1st to 7th insulating layers 61*a* to 61*g* is provided with a 1st and a 2nd external electrode on one of the opposing side faces parallel to the longer axis of the body (on the front side in FIG. 6), and with a 3rd and a 4th external electrode on the other side face. The 1st extended conductor 62*a* is electrically connected to the 1st external electrode; the 2nd extended conductor 62*b* is electrically connected to the 3rd external electrode; the 3rd extended conductor 62*c* is electrically connected to the 2nd external electrode; and the 4th extended conductor 62*d* is electrically connected to the 4th external electrode.

The electronic component 60 of the fifth embodiment having such a structure produced the same effect as the electronic component of the third embodiment. In the electronic component of the fifth embodiment, the 2nd-C spiral conductor 63*c* that is a portion of the 2nd spiral conductor is located between the 1st-A and the 1st-B spiral conductor 63*a* and 63*b* of the 1st spiral conductor, and the 1st-B spiral conductor 63*b* that is a portion of the 1st spiral conductor is located between the 2nd-C and the 2nd-D spiral conductor 63*c* and 63*d* of the 2nd spiral conductor. In other words, in the electronic component of the fifth embodiment, the elements of the 1st spiral conductor, each of which is a portion of the first spiral conductor, and the elements of the second spiral conductor, each of which is a portion of the second spiral conductor, are alternately arranged. Thus, the magnetic coupling between the 1st spiral conductor (primary coil) and the 2nd spiral conductor (secondary coil) can be enhanced, and the stray capacitance therebetween can be reduced. In addition, the structure of the 1st and the 2nd spiral conductor, each including a plurality of spiral conductor layers, increases the line length of each of the 1st and the 2nd spiral conductor, thus increasing common mode impedance (Zc).

Modification 1 of Fifth Embodiment

In the electronic component 60 of the fifth embodiment, the insulating layer 61*d* having the four extended conductors 62*a* to 62*d* thereon is located between the insulating layer 61*c* having thereon the 2nd-C spiral conductor 63*c* that is a portion of the secondary coil and the insulating layer 61*e* having thereon the 1st-B spiral conductor 63*b* that is a portion of the primary coil, as described above. The fifth embodiment is, however, not limited to this structure and may be modified into a structure in which the insulating layer having the extended conductors thereon is located outside the portion defined by the insulating layers having the spiral conductors constituting the primary coil and the spiral conductors constituting the secondary coil. This arrangement allows the spiral conductors constituting the primary coil and the spiral conductors constituting the secondary coil to be arranged close to each other, consequently enhancing the magnetic coupling between the primary coil and the secondary coil.

Modification 2 of Fifth Embodiment

In the electronic component 60 of the fifth embodiment, the 1st spiral conductor (primary coil) and the 2nd spiral conductor (secondary coil) are each constituted of two spiral conductors. The fifth embodiment is, however, not limited to this structure and may be modified into a structure in which the 1st spiral conductor (primary coil) and the 2nd spiral conductor (secondary coil) are each constituted of three or more spiral conductors. This structure increases the line length of each of the 1st spiral conductor (primary coil) and the 2nd spiral conductor (secondary coil), consequently further increasing common mode impedance (Zc).

Modification 3 of Fifth Embodiment

Modifications 1 and 2 of the fifth embodiment may be combined into a structure in which the 1st spiral conductor (primary coil) and the 2nd spiral conductor (secondary coil) are each constituted of three or more spiral conductor layers disposed on the respective insulating layers adjacent to each other while the insulating layer having the extended conductors thereon is disposed outside the portion defined by the insulating layers having the spiral conductors.

Sixth Embodiment

Figure 7:
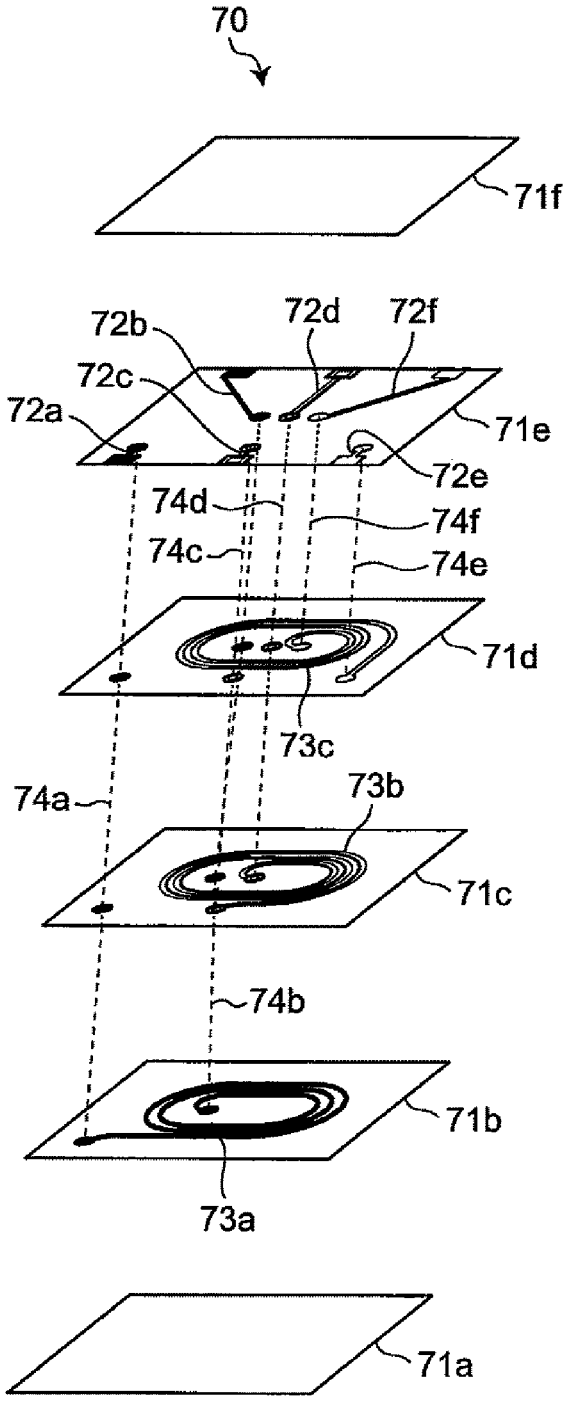
FIG. 7 is a schematic exploded perspective view of an electronic component according to a sixth embodiment of the present invention.

An electronic component 70 according to a sixth embodiment is a three-line common mode choke coil having a primary, a secondary, and a tertiary coil, and includes a 1st to a 6th insulating layer 71*a* to 71*f* as shown in FIG. 7. The 5th insulating layer 71*e* that is one of the insulating layers is provided thereon with a 1st and a 2nd extended conductor 72*a* and 72*b* connected to the primary coil, a 3rd and a 4th extended conductor 72*c* and 72*d* connected to the secondary coil, and a 5th and a 6th extended conductor 72*e* and 72*f* connected to the tertiary coil. A 1st spiral conductor 73*a* defining the primary coil is disposed on the 2nd insulating layer 71*b*; a 2nd spiral conductor 73*b* defining the secondary coil is disposed on the 3rd insulating layer 71*c*; and a 3rd spiral conductor 73*c* defining the tertiary coil is disposed on the 4th insulating layer 71*d*. One of the end portions of the 1st spiral conductor 73*a* is electrically connected to the 1st extended conductor 72*a* with a VIA 74*a* passing continuously through the 3rd to 5th insulating layers 71*c*, 71*d*, and 71*e*, and the other is electrically connected to the 2nd extended conductor 72*b* with a VIA 74*b* passing continuously through the 3rd to 5th insulating layers 71*c*, 71*d*, and 71*e*. One of the end portions of the 2nd spiral conductor 73*b* is electrically connected to the 3rd extended conductor 72*c* with a VIA 74*c* passing through the 4th and 5th insulating layers 71*d* and 71*e*, and the other is electrically connected to the 4th extended conductor 72*d* with a VIA 74*d* passing through the 4th and 5th insulating layers 71*d* and 71*e*. Similarly, one of the end portions of the 3rd spiral conductor 73*c* is electrically connected to the 5th extended conductor 72*e* with a VIA 74*e* formed in the 5th insulating layer 71*e*, and the other is electrically connected to the 6th extended conductor 72*f* with a VIA 74*f* formed in the 5th insulating layer 71*e*. The body (not shown) including the stacked 1st to 7th insulating layers 71*a* to 71*f* is provided with a 1st, a 3rd, and a 5th external electrode on one of the opposing side faces parallel to the longer axis of the body (on the front side in FIG. 7), and with a 2nd, a 4th, and a 6th external electrode on the other side face. The 1st extended conductor 72*a* is electrically connected to the 1st external electrode; the 2nd extended conductor 72*b* is electrically connected to the 2nd external electrode; the 3rd extended conductor 72*c* is electrically connected to the 3rd external electrode; the 4th extended conductor 72*d* is electrically connected to the 4th external electrode; the 5th extended conductor 72*e* is electrically connected to the 5th external electrode; and the 6th extended conductor 72*f* is electrically connected to the 6th external electrode.

The 1st spiral conductor 73*a* (primary coil) and the adjacent 2nd spiral conductor 73*b* (secondary coil) are magnetically coupled, and the 2nd spiral conductor 73*b* (secondary coil) and the adjacent 3rd spiral conductor 73*c* (tertiary coil) are magnetically coupled. Thus, the electronic component 70 of the sixth embodiment is embodied as a three-line common mode choke coil.

The electronic component 70 of the sixth embodiment having such a structure produced the same effect as in the third embodiment.

Modification 1 of Sixth Embodiment

In the electronic component of the sixth embodiment, the 4th insulating layer 71*e* having the six 1st to 6th extended conductors 72*a*, 72*b*, 72*c*, 72*d*, 72*e*, and 72*f* thereon is located on the outer side of the insulating layer 71*d* having the 3rd spiral conductor 73*c* thereon. The sixth embodiment is however not limited to this structure and may be modified in such a manner that the 4th insulating layer having the 1st to 6th extended conductors 72*a*, 72*b*, 72*c*, 72*d*, 72*e*, and 72*f* thereon is located between the 1st spiral conductor 73*a* and the 2nd spiral conductor 73*b* or between the 2nd spiral conductor 73*b* and the 3rd spiral conductor 73*c*. This arrangement in which the insulating layer having the extended conductors thereon is disposed between any two of the spiral conductors can increase the distance between the spiral conductors to reduce the stray capacitance between the spiral conductors.

The electronic component of the sixth embodiment, in which the six extended conductors 72*a*, 72*b*, 72*c*, 72*d*, 72*e*, and 72*f* are disposed together on the single insulating layer 71*e* of the insulating layers, is not limited to this structure and may be modified in such a manner that the six extended conductors 72*a*, 72*b*, 72*c*, 72*d*, 72*e*, and 72*f* are disposed separately on two or more insulating layers. If the six extended conductors 72*a*, 72*b*, 72*c*, 72*d*, 72*e*, and 72*f* are disposed separately on two or more insulating layers, the two or more insulating layers may be located outside the portion defined by the insulating layers having the 1st to 3rd spiral conductors 73*a* to 73*c*, or between the 1st and the 2nd spiral conductor 73*a* and 73*b* or between the 2nd and the 3rd spiral conductor 73*b* and 73*c*.

Modification 2 of Sixth Embodiment

Although the primary coil, the secondary coil, and the tertiary coil of the electronic component 70 of the sixth embodiment each include a single spiral conductor, at least one of the primary coil, the secondary coil, and the tertiary coil may include two or more spiral conductors, or all the coils may be include two or more spiral conductors.

As described above, the three-line common mode choke coil of the sixth embodiment may be modified in a variety of ways according to the required properties and specifications.

EXAMPLES

The present disclosure will be further described in detail with reference to some Examples, but it is not limited to the following Examples.

Example 1

An electronic component having the structure shown in in FIG. 4 was produced. The electronic component included the following members or materials having the following dimensions.

Insulating layer 41*a*: Ni—Cu—Zn ferrite

Insulating layers 41*b* to 41*f*: borosilicate glass

Thickness of the insulating layers: 18 μm

Line width of the spiral conductors: 18 μm

Line spacing of the spiral conductors: 18 μm

First, green sheets of the insulating layers 41*a* to 41*f* were prepared. VIA holes are formed in the green sheets of the insulating layers 41*c* and 41*e* by laser processing and were then filled with a conductive paste to form VIAs 44*a* to 44*d*. Then, conductor patterns of spiral conductors 43*a* and 43*b* were screen printed on the green sheets of the insulating layers 41*c* and 41*d*, respectively, and conductor patterns of extended conductors 42*a*, 42*b*, 42*c*, and 42*d* were formed on the green sheets of the corresponding insulating layers 41*b* and 41*e*. The green sheets were stacked, and the stack was fired at 900° C. for 120 min to yield a body. Then, the body was chamfered by barrel polishing. After forming external electrodes by baking, the external electrodes were subjected to nickel/tin plating to yield an electronic component.

In this process, for forming the spiral conductors, a conductive paste containing Ag and 1.3% by mass of $Al_2O_3$ was used. On the other hand, for forming the extended conductors, a conductive paste containing Ag but none of the oxides, such as $Al_2O_3$, was used.

Comparative Example 1

An electronic component was produced in the same manner as in Example 1, except that the conductive paste of Example 1 containing Ag but none of the oxides, such as $Al_2O_3$, was used for forming the spiral conductors.

Comparative Example 2

An electronic component was produced in the same manner as in Example 1, except that the conductive paste of Example 1 containing Ag and 1.3% by mass of $Al_2O_3$ was used for forming the extended conductors.

Comparison of the Incidence of Initial Defects

The electronic components of Example 1 and Comparative Example 1 were examined for the incidence of initial defects in insulation resistance (IR). The results are shown in the Table. The examination was conducted as below.

Test Procedure

Insulation Resistance (IR)

A direct current of 5 V was applied between the 1st spiral conductor (primary coil) and the 2nd spiral conductor (secondary coil) of each of the electronic components of Example 1 and Comparative Example 1, and the insulation resistance (IR) at this time was measured with a digital electrometer 8340A (manufactured by Advantest). When the IR was not 10 MΩ or more, it was determined to be defective, and the incidence of defects was calculated (number of samples: n=100,000).

Results

TABLE

| | Incidence (%) of IR defects |
|---|---|
| Example 1 | 0.61 |
| Comparative Example 1 | 35.72 |

The Table suggests that the electronic component of Example 1, which included spiral conductors containing Ag and $Al_2O_3$ on insulating layers containing glass and extended conductors containing Ag but no $Al_2O_3$ on insulating layers containing glass, exhibited a higher insulation reliability and a lower percentage of initial defects in IR than the electronic component of Comparative Example 1, which included spiral conductors containing Ag but no $Al_2O_3$ and extended conductors containing Ag but no $Al_2O_3$.

Glass Coating on End Portion of Extended Conductor

Figure 9:
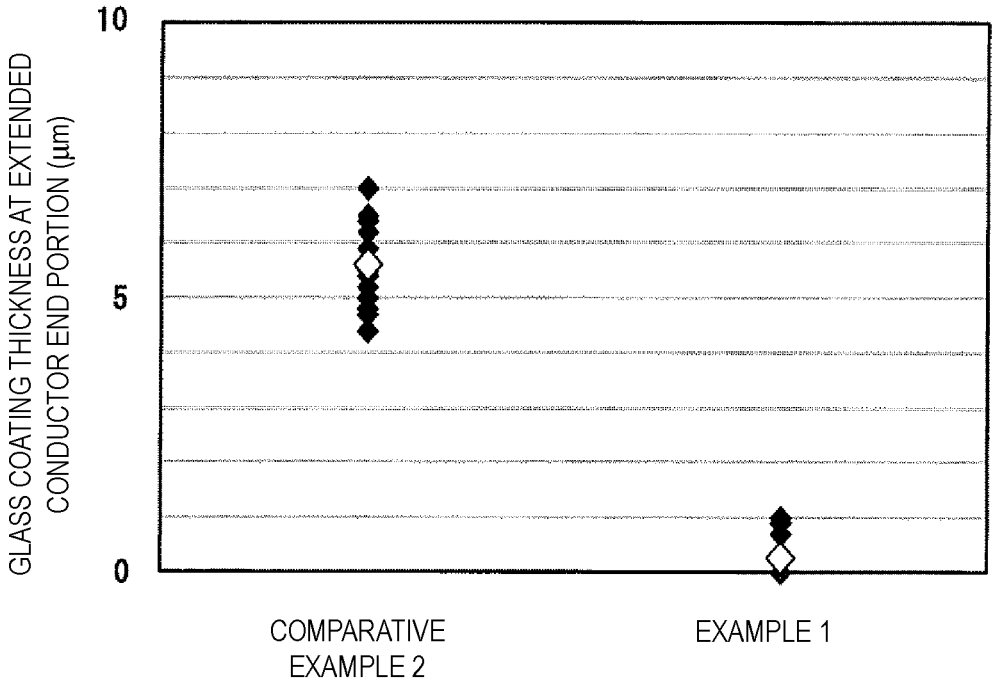
FIG. 9 is a plot of the thickness of a glass coating formed at an end portion of an extended conductor after firing in the manufacturing process of the common mode choke coils of Example 1 and Comparative Example 2.

The electronic components of Example 1 and Comparative Example 2 were examined for the thickness of the glass coating formed over an end portion of an extended conductor. The results are shown in FIG. 9.

Test Procedure

Thickness of Glass Coating

For measuring the thickness of the glass coating, an end portion of the 1st extended conductor 42*a*, extracted onto one of the side faces parallel to the longer axis of the body (on the front side in FIG. 4) was measured. More specifically, the body was cut along the portion having the 1st extended conductor 42*a* in the stacking direction, and the thickness of the glass coating at the section was measured by using the length measuring function of a microscope. FIG. 9 shows the results obtained by measurement for fired bodies (number of samples: n=12, solid diamond: measured value, outline diamond: average).

Results

FIG. 9 shows that the thickness of the glass coating was about 1 μm or less in Example 1. On the other hand, in Comparative Example 2, the glass coating had a thickness of about 4 μm to 7 μm.

Since the end portions of the extended conductors were ground about 2 μm to 3 μm by barrel polishing after firing, the glass coating on the end portion of the extended conductor on one side face in Example 1 was removed with reliability. Accordingly, the external electrodes were connected to the respective extended conductors with reliability.

Therefore, the electronic component of Example 1, which included spiral conductors containing Ag and $Al_2O_3$ on insulating layers containing glass and extended conductors containing Ag but no $Al_2O_3$ on insulating layers containing glass, exhibited a higher connection reliability than the electronic component of Comparative Example 2, which included spiral conductors and extended conductors, each containing Ag and $Al_2O_3$.

Electronic components produced in the same manner as in Example 1 except that $Al_2O_3$ was replaced with $SiO_2$, ZnO, $TiO_2$, or $ZrO_2$ exhibited the same tendency. In addition, electronic components having the structures of fourth to sixth embodiments shown in FIGS. 5 to 7 and produced using conductors having the same compositions as in Example 1 also exhibited the same tendency as in Example 1 and high reliability in both insulation and connection with external electrodes.

While preferred embodiments of the disclosure have been described above, it is to be understood that variations and modifications will be apparent to those skilled in the art without departing from the scope and spirit of the invention. The scope of the invention, therefore, is to be determined solely by the following claims.

What is claimed is:

1. An electronic component comprising:

a body containing glass;

external conductors including a first external electrode and a second external electrode each disposed on an external surface of the body;

a spiral conductor disposed within the body; and extended conductors including a first extended conductor and a second extended conductor each disposed within the body, wherein one end portion of the spiral conductor is electrically connected to the first external electrode with the first extended conductor therebetween and another end portion of the spiral conductor is electrically connected to the second external electrode with the second extended conductor therebetween, and wherein the spiral conductor contains Ag and at least one oxide selected from the group consisting of $Al_2O_3$, $SiO_2$, ZnO, $TiO_2$, and $ZrO_2$, and the extended conductors contain Ag, but none of $Al_2O_3$, $SiO_2$, ZnO, $TiO_2$, and $ZrO_2$.

2. The electronic component according to claim 1, wherein the body includes a plurality of stacked insulating layers.

3. The electronic component according to claim 2, wherein the spiral conductor is disposed on an insulating layer different from an insulating layer on which the first extended conductor and the second extended conductor are disposed.

4. The electronic component according to claim 3, wherein the external conductors further include a third external electrode and a fourth external electrode each disposed on an external surface of the body, the spiral conductor includes a first spiral conductor and a second spiral conductor disposed on different insulating layers within the body, and the extended conductors further include a third extended conductor and a fourth extended conductor disposed within the body, wherein one end portion of the first spiral conductor is electrically connected to the first external electrode with the first extended conductor therebetween and another end portion of the first spiral conductor is electrically connected to the second external electrode with the second extended conductor therebetween, and wherein one end portion of the second spiral conductor is electrically connected to the third external electrode with the third extended conductor therebetween and another end portion of the second spiral conductor is electrically connected to the fourth external electrode with the fourth extended conductor therebetween, and the second spiral conductor is disposed on an insulating layer different from an insulating layer on which the third extended conductor and the fourth extended conductor are disposed and is magnetically coupled with the first spiral conductor.

5. The electronic component according to claim 4, wherein the first to fourth extended conductors are disposed on the same insulating layer.

6. The electronic component according to claim 4, wherein the first to fourth extended conductors are disposed between the first spiral conductor and the second spiral conductor in a direction in which the insulating layers are stacked.

7. The electronic component according to claim 4, wherein the first to fourth extended conductors are disposed outside of the spiral conductors in a direction in which the insulating layers are stacked.

8. The electronic component according to claim 4, wherein the first and second spiral conductors each include conductors disposed on two or more insulating layers and electrically connected to each other.

9. The electronic component according to claim 8, wherein the conductors of the first spiral conductor and the conductors of the second spiral conductor are alternately arranged.

10. The electronic component according to claim 4, wherein the external conductors further include a fifth external electrode and a sixth external electrode each disposed on an external surface of the body, the spiral conductor further includes a third spiral conductor, and the extended conductors further include a fifth extended conductor and a sixth extended conductor disposed within the body, and wherein one end portion of the third spiral conductor is electrically connected to the fifth external electrode with the fifth extended conductor therebetween and another end portion of the third spiral conductor is electrically connected to the sixth external electrode with the sixth extended conductor therebetween, and the third spiral conductor is disposed on an insulating layer different from an insulating layer on which the fifth and sixth extended conductors are disposed, different from the insulating layer on which the first spiral conductor is disposed, and different from the insulating layer on which the second spiral conductor is disposed, and the third spiral conductor is magnetically coupled with the first spiral conductor and magnetically coupled with the second spiral conductor.

11. The electronic component according to claim 10, wherein the first to sixth extended conductors are disposed on a same insulating layer.

12. The electronic component according to claim 10, wherein the first to sixth extended conductors are disposed between the first spiral conductor and the second spiral conductor, and/or between the second spiral conductor and the third spiral conductor, and/or between the third spiral conductor and the first spiral conductor in a direction in which the insulating layers are stacked.

13. The electronic component according to claim 10, wherein the first to sixth extended conductors are disposed outside of the spiral conductors in a direction in which the insulating layers are stacked.

14. The electronic component according to claim 10, wherein the first to third spiral conductors each include conductors disposed on two or more insulating layers and electrically connected to each other.

15. The electronic component according to claim 2, wherein the body further includes a magnetic layer mainly containing ferrite on at least one side in a direction in which the insulating layers are stacked.

16. The electronic component according to claim 1, wherein the proportion of the at least one oxide selected from the group consisting of $Al_2O_3$, $SiO_2$, ZnO, $TiO_2$, and $ZrO_2$ in the spiral conductor is in the range of about 0.1% by mass to 5.0% by mass relative to the total mass of the Ag and the at least one oxide.

* * * * *